US006315052B1

(12) United States Patent
Sola

(10) Patent No.: US 6,315,052 B1
(45) Date of Patent: Nov. 13, 2001

(54) METHOD AND A DEVICE FOR USE IN COILED TUBING OPERATIONS

(76) Inventor: Kjell I. Sola, Messeguttveien 14, Tananger N-4056 (NO)

( * ) Notice: Subject to any disclaimer, the term of this patent is extended or adjusted under 35 U.S.C. 154(b) by 0 days.

(21) Appl. No.: 09/445,915

(22) PCT Filed: Jun. 10, 1998

(86) PCT No.: PCT/NO98/00175

§ 371 Date: Mar. 17, 2000

§ 102(e) Date: Mar. 17, 2000

(87) PCT Pub. No.: WO98/59149

PCT Pub. Date: Dec. 30, 1998

(30) Foreign Application Priority Data

Jun. 25, 1997 (NO) ..... 972958

(51) Int. Cl.[7] ..... E21B 19/084; E21B 19/22; E21B 23/14

(52) U.S. Cl. ..... 166/384; 166/77.2; 166/78.1; 166/381; 175/162

(58) Field of Search ..... 166/77.1, 77.2, 166/78.1, 381, 384, 385; 175/162

(56) References Cited

U.S. PATENT DOCUMENTS 4,515,220 5/1985 Sizer et al. ..... 166/384
4,655,291 * 4/1987 Cox ..... 166/385
4,673,035 * 6/1987 Gipson ..... 166/77.1
5,360,075 11/1994 Gray ..... 175/61
5,660,235 8/1997 Sola .
6,158,516 * 12/2000 Smith et al. ..... 166/385

* cited by examiner

*Primary Examiner*—David Bagnell
*Assistant Examiner*—Jennifer H Gay
(74) *Attorney, Agent, or Firm*—John J. Ryberg; Victor H. Segura

(57) ABSTRACT

In a method for use in coilable tubing operations, such as onshore and offshore drilling for oil/gas, a coilable tubing (34) is used. The coilable tubing (34) is coiled up on a drum (36) and uncoiled therefrom by means of a feed-in and feed-out injector (32), said drum 936) being rotatable about its own axis. In order to enable rotation of the coilable tubing 934) within the well such that the angled transition piece carrying the bit is rotated to take the correct orientation, in order to enable drilling along a predetermined path without having to use a downhole orientation tool, the coilable tubing (34) is put into rotational movements during forwardly feeding thereof. To this end, the drum 936) and the underlying injector (32) may be placed on a rotary table (30) having a vertical rotational axis (A—A) aligned with the vertical symmetry axis of an underlying blowout preventer (28). The drum (36) for the coilable tubing (34) is, preferably, eccentrically positioned on the rotary table (30). The rotating forwardly feeding movements of the coilable tubing (34) also result in very considerable friction reductions within the bore hole, resulting in an increased weight load on the bit and, thus, increased drilling rate, as well as a longer horizontal hole length.

7 Claims, 1 Drawing Sheet

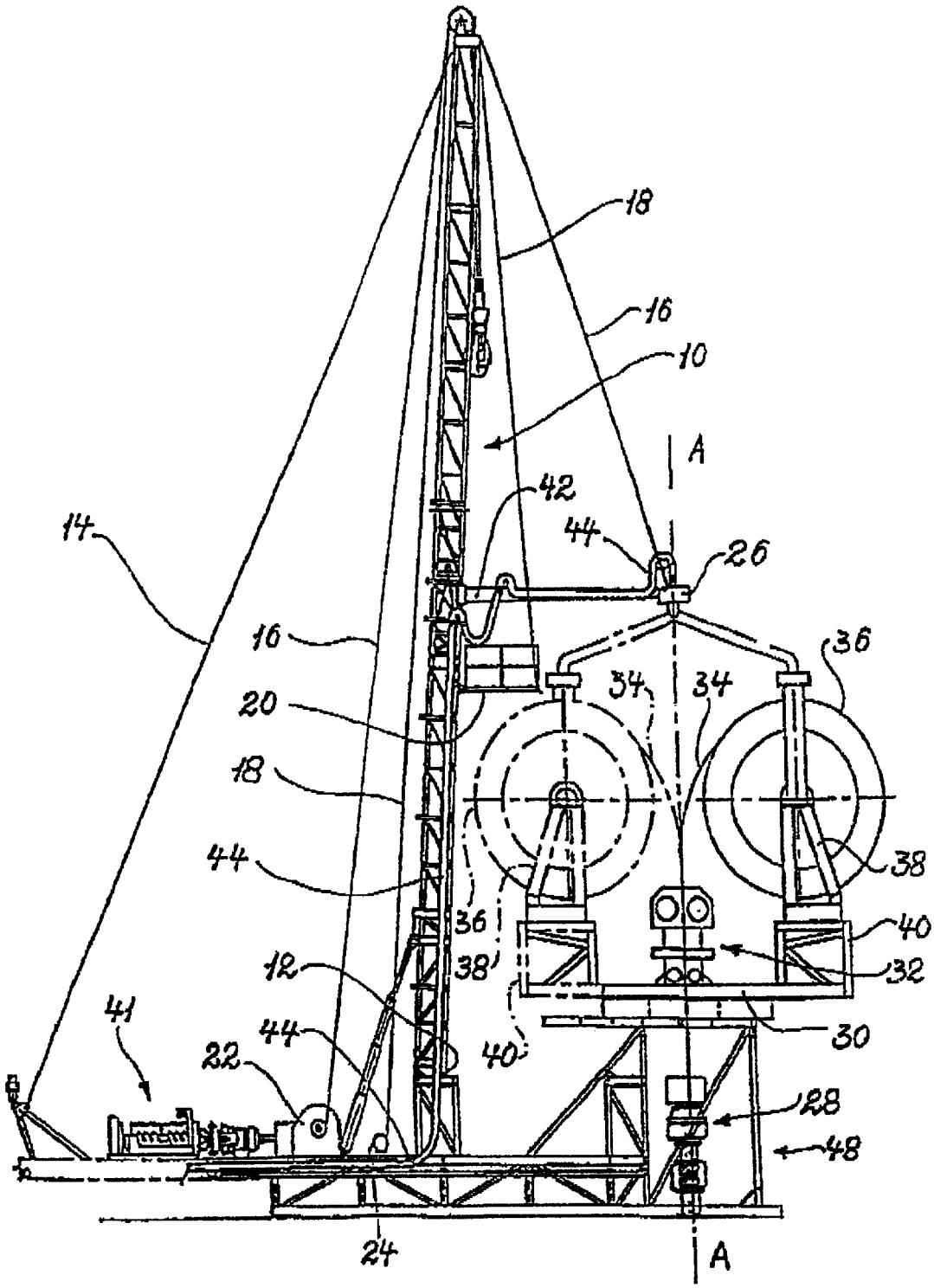
18
16
10
A
42
44
26
14
16
36
34
34
20
18
38
44
36
40
38
32
12
30
41
44
40
22
28
48
24
A

METHOD AND A DEVICE FOR USE IN COILED TUBING OPERATIONS

This invention relates to a method for use in coiled tubing operations, such as e.g. onshore and offshore drilling for oil/gas, using a tubing coilable on a rotary drum and adapted to be uncoiled from the drum by means of an injector, and where the coiling drum is disposed in a suitable position, taking an expedient orientation in relation to the injector which, in an onshore drilling operation is orientated aligned with a blower preventer or the like at the top of the bore hole.

BACKGROUND OF THE INVENTION

Likewise, the invention relates to a device for carrying out this method, comprising a coilable tubing coiled on a rotary drum and, possibly, assigned one or more separate drums carrying additional coilable tubing coiled thereon, outer ends of coilable tubings on two drums being interconnectable by means of cooperating threads; and injector which in the position of use is located in a position where the axis thereof coincides with the axis of a blow-out preventer; and wherein the injector has a favourable position and orientation in relation to the rotary drum with the coilable tubing coiled thereon.

In connection with coiled tubing operations generally, e.g. drilling operations, it is known to position and align the tubing coil on the rotary drum such in relation to the through-going passage/axis of the injector that an imaginary extension of said passage/axis passes substantially tangentially in relation to the outer circumference of the tubing coil on the drum. Thus, strains acting on the coilable tubing through bendings and straightenings, causing plastic deformation thereof, are reduced.

Norwegian patent application No. 953587 discloses a method and a device for use in coiled tubing operations. According to the above-mentioned application, the coiling/uncoiling drum for the tubing, in addition to its capability of rotating around the axial symmetry axis thereof, is adapted to pivot gradually about a horizontal axis during the coiling on/off of the coilable tubing, in a direction towards the injector upon uncoiling and in the opposite direction whenever the coilable tubing is in the act of being coiled onto the drum. The tangential course of the imaginary extension of the injector's through-going coilable tubing passage in relation to the outer circumference of the tubing coil on the drum is, thus, maintained at any time, irrespective of the size of the tubing coil diameter.

The above-mentioned features represent technical advantages when carrying out coilable tubing operations, but they have no significant influence on the general course of the coilable tubing within the bore hole, below the blowout preventer.

During drilling, such coilable tubing does not follow a rectilinear course but rather an elongate, substantially helical path within the bore hole, and creates a number of contact points/areas in which the friction between the coilable tubing and the bore hole wall can be substantial. In the outer end portion of the coilable tubing, the bit is disposed at the end of an angular transition piece (a so-called bent housing) having an orientation tool and a drive motor at the immediately upstream side of the transition piece. The helical course of the coilable tubing within the bore hole and the prevailing frictional conditions will, especially in connection with a substantial fed-in coilable tubing length, counteract and, in individual cases, prevent feed-in of further coilable tubing length in the drilling direction.

In order to reduce the friction between the coilable tubing and the layers of the crust of the earth (the formation layers), so that the feeding of the coilable tubing is favoured, simultaneously counteracting that the coilable tubing get stuck within the bore hole due to the tight coilable tubing windings combined with a high friction with regard to the bore hole wall, one proceeds in accordance with the inventions as defined in the claims, respectively by means of a drilling equipment as set forth in the claims.

According to the invention, the coilable tubing is put into rotational movements during its feeding movements, the coiled tubing drum with tubing coiled thereon and the injector being put into rotational movements about an axis extending right angled to the rotational axis of the drum, coinciding with the axis of the through-going passage of the injection.

Thus, the tubing drum with coilable tubing coiled thereon can follow a rotational movement along an annular path while the injector rotates about its own vertical axis.

Alternatively, also the drum with coilable tubing coiled thereon can be put into rotational movements about a vertical symmetry axis passing through the rotational axis thereof.

In one constructively built up embodiment, the rotary drum with coilable tubing coiled thereon and the injector may be mounted on a common, driven turret/rotary table having a vertical rotational axis aligned with the longitudinal central axis of the underlying blowout preventer, the drum being disposed, supported on a frame rack at the circumference of the turret, while the injector is mounted at the center of the turret, so that the axis of its through-going passage for the coilable tubing and the rotational axis of the turret coincides. Drilling fluid is supplied to the coilable tubing through the horizontal hollow core of the drum from a supply hose suspended from the free outer end of a carrying arm projecting from a mast of the rig.

In another embodiment, the drum with coilable tubing coiled thereon and rotary along two axes crossing each other perpendicularly, usually a horizontal axis for the coilable tubing's uncoiling and coiling operations and a vertical axis for allotting the coilable tubing a rotational movement during feeding, may be suspended from the derrick below e.g. a hydraulic rotary motor. The supply of drilling fluid to the coilable tubing may be arranged as in the first embodiment.

A considerable advantage achieved through rotating the coilable tubing during feeding thereof is that the orientation tool which previously served to adjust the angled transition piece with the bit rotationally, now may be deleted. Thus, also the hydraulic hoses needed for turning the angled transition piece can be omitted. Thus, one avoids a separate motor for rotating the angled transition piece with the bit, the angled transition piece being rotated by means of the coilable tubing string, so that the transition piece may be orientated in the correct direction for drilling along a predetermined path. Another considerable advantage is that the reduced friction between coilable tubing and bore hole wall results in that the bit is subjected to a larger weight load, resulting in increased drilling rate as well as horizontal hole length.

Drilling mud to the drilling machine/bit and hydraulic energy for operating the injector, come from pumping aggregates of the plant.

As known, the mast of the rig may be adapted to be pushed to and fro across the bore hole.

The coilable tubing may be jointed to a coiled extension tubing by means of end connections of the thread type, as well as drill collars may be mounted into the string in order to increase the weight on the bit.

BRIEF DESCRIPTION OF THE DRAWING

A non-restricting example of a method and a device according to the invention is further explained in the following, reference being made to the accompanying drawing, in which the only figure shows a side elevational view of a rig.

DETAILED DESCRIPTION OF THE INVENTION

In the embodiment shown in the figure, a coilable tubing coiling drum is rotatably disposed about a horizontal axis and assigned an underlying injector, both being placed on a rotary table having a vertical rotational axis. The rotary table puts the drum and, thus, the coilable tubing in rotational movements about said vertical axis coinciding both with the central axis of the injector's vertically through-going passage for the coilable tubing, and with the vertical central axis of an underlying blowout preventer, the drum which, upon the rotation of the rotary table, moves along a horizontal, annular path, being shown in two positions where corresponding vertical symmetry axes form an angle of 180° with each other.

The rig shown in the drawing comprises an upright mast or derrick, respectively, denoted 10. The mast may be pivotally disposed through an articulation 12 by means of a virgorous telescopic cylinder, and may be strengthened and braced by means of guys 14.

A blowout preventer having a vertical longitudinal axis in the examplary embodiment is denoted at 28.

On the horizontal rotary table 30, the rotational axis A—A thereof also forming an axis for the blowout preventer 28, is centrally placed an injector 32 of the type conventionally used in connection with coilable tubing's 34 feed-out and feed-in in relation to a tubing coiling/unspooling drum 36 rotatably disposed about a horizontal axis and which, according to the examplary embodiment, is placed at the periphery of the rotary table 30. Thus, the drum 36 follows a horizontal annular path when the rotary table 30 rotates about the axis A—A, whereby the coilable tubing 34 is put in rotational movements in association with its forwardly feeding movement. The projecting horizontal tabs of the drum shaft are rotationally suspended at the top of a bearing block 38 firmly mounted on a frame rack 40 which, in its turn, is attached to the top face of the rotary table 30.

The rotary table 30 develops e.g. a torsional moment of 20,000 ft/lbs and may carry out between 5 and 10 revolutions per minute. The derrick structure and winches as well as a power pack 41 are shaped and designed such that the former can be displaced through sliding along the deck about 5 meters in order to allow the coiling drum 36 for coilable tubing to rotate 360° around the axis A—A.

The free end of a support arm 42 projecting horizontally from the mast/derrick 10 carries, through a swivel 26, one or more tubular arms which, within the area of the common rotational axis A—A, each has a downwardly sloping course and passes into a vertical pipe communicating with the hollow middle portion/shaft of the drum 36, in order to be supplied with drilling mud for the coilable tubing 34 and, from there, to the drilling machine and the bit (not shown) through a hose 44. The rotary table 30 is mounted on an underlying frame rack 48. The support arm 42 can be raised and lowered by means of a wire 16 connected to a winch 22. A working platform 20 can be raised and lowered by means of a wire 18 connected to a winch 24.

The rig equipment's construction, its shape and design and not least the mounting thereof may undergo modifications within the scope of the invention as defined by means of the following claims. The essence of the invention is the possibility of putting a coilable tubing while feeding the tubing in rotational movements about the axis thereof (=the axis of the bore hole). This is effected through rotating the coiling drum and assigned injector in a surface position, in order to rotate the coilable tubing within the well such that said angled transition piece with the bit outermost is in the correct direction to drill along a predetermined path. In accordance with other important aspects of the invention, the rotation of the coilable tubing string results in a considerable reduction of the friction within the bore hole as compared with prior art technique. This involves a larger weight load on the bit and, thus, to an increased drilling rate and hole length.

What is claimed is:

1. A method for use in coilable tubing operations taking place during well work in which a portion of a coilable tubing (34) uncoiled from a storage drum (36) is passed through a coilable tubing injector (32) and inserted in a well through an inlet, said method comprising the steps of:

placing the coilable tubing storage drum and the injector on a table rotatable about an axis (A—A) which is aligned with the inlet of the well, the injector with the tubing passing therethrough being aligned with the axis of the table; and rotating the table with the drum and injector about the axis to rotate the portion of the coilable tubing (34) inserted in the well about a longitudinal axis of the coiled tubing.

2. A method as set forth in claim 1 wherein the step of placing the drum on the rotatable table is further defined as placing the drum to be radially displaced from the axis of the table.

3. A device for use in coilable tubing operations during well work, said device comprising:

a rotary table (3) having a vertically extending rotational axis (A—A) aligned with an inlet of a well;

a drum (36) for coilable tubing (34) mounted on said table; and a coilable tubing injector mounted on said table in alignment with said axis, said injector receiving tubing from said drum and inserting a portion of the coilable tubing (34) into the well through the inlet, rotation of said table about the axis rotating the portion of the tubing in the well about a longitudinal axis of the tubing.

4. A device as set forth in claim 3, wherein the drum (36) is radially displaced from said axis (A—A) and said injector (32).

5. A device as set forth in claim 4, having a rig, wherein the rig comprises a projecting support arm (42) above the rotary table (30), the support arm's (42) free outer end being provided with a swivel means (26), the swivel axis coinciding with said rotational axis (A—A).

6. A device as set forth in claim 3, having a rig, and wherein the rig comprises a projecting support arm (42) above the rotary table (30), the support arm's (42) free outer end being provided with a swivel means (26), the swivel axis coinciding with said rotational axis (A—A).

7. A device as set forth in claim 6, wherein drilling fluid is supplied to the coilable tubing (34) through a supply hose or pipe (44) passed through the swivel means (26) to a hollow shaft of the drum (36), the end of the coilable tubing (34) being connected to said shaft.

* * * * *